US007566187B2

(12) United States Patent
Dyke et al.

(10) Patent No.: US 7,566,187 B2
(45) Date of Patent: Jul. 28, 2009

(54) TOWABLE ELONGATED TRAFFIC BARRIER

(75) Inventors: Gerrit Dyke, Stockton, CA (US); Alvaro E. Morales Flores, Concord, CA (US)

(73) Assignee: Barrier Systems, Inc., Vacaville, CA (US)

( * ) Notice: Subject to any disclaimer, the term of this patent is extended or adjusted under 35 U.S.C. 154(b) by 0 days.

(21) Appl. No.: 11/980,840

(22) Filed: Oct. 31, 2007

(65) Prior Publication Data

US 2008/0286042 A1 Nov. 20, 2008

Related U.S. Application Data

(62) Division of application No. 11/655,302, filed on Jan. 19, 2007, now Pat. No. 7,393,154.

(51) Int. Cl.
*E01F 15/00* (2006.01)

(52) U.S. Cl. ..... 404/6

(58) Field of Classification Search ..... 404/6; 256/13.1

See application file for complete search history.

(56) References Cited

U.S. PATENT DOCUMENTS

| | | | | |
|---|---|---|---|---|
| 4,632,598 | A * | 12/1986 | Richards | 404/6 |
| 4,666,332 | A | 5/1987 | Burgett | |
| 5,007,763 | A | 4/1991 | Burgett | |
| 6,485,224 | B1 | 11/2002 | Dyke | |
| 6,832,870 | B1 * | 12/2004 | Krivoy | 404/6 |
| 6,984,088 | B1 * | 1/2006 | Krivoy | 404/6 |
| 7,354,218 | B1 * | 4/2008 | Dyke et al. | 404/6 |
| 7,393,154 | B1 * | 7/2008 | Dyke et al. | 404/6 |
| 2001/0048845 | A1 * | 12/2001 | Jack | 404/6 |

* cited by examiner

*Primary Examiner*—Gary S Hartmann
(74) *Attorney, Agent, or Firm*—Thomas R. Lampe

(57) ABSTRACT

A towable, articulated elongated traffic barrier includes traffic barrier modules having articulating interconnected ends. A restrictor element restricts articulation between adjacent modules. Each module includes two spaced wheel assemblies positioned inwardly from the ends thereof.

7 Claims, 8 Drawing Sheets

44
44
40
76
42
66
60
22
20
50
36
34
18
34
20
54
42
44
44
52
50

44
44
40
44
22
54
20
34
36
40
44
44

TOWABLE ELONGATED TRAFFIC BARRIER

This application is a divisional application based on U.S. patent application Ser. No. 11/655,302, filed Jan. 19, 2007 now U.S. Pat. No. 7,393,154.

TECHNICAL FIELD

This invention relates to a towable elongated traffic barrier including a plurality of rigid, elongated double-ended traffic barrier modules connected at the ends thereof and incorporating structure controlling relative movement between the traffic barrier modules during repositioning of the elongated traffic barrier by a tow vehicle.

BACKGROUND OF THE INVENTION

Traffic barriers including a plurality of barrier sections pivotally connected in end-to-end relationship are generally known. It is also known to incorporate with portable traffic barriers ground engaging wheels facilitating towing of the traffic barrier by a tow vehicle.

U.S. Pat. No. 5,007,763, issued Apr. 16, 1991, discloses an arrangement wherein a traffic barrier section includes a centrally-located, built-in carrier. The carrier includes a fluid-operated ram which is connected to an axle carrying wheels located below the ram. When the wheels are in a retracted position, the barrier section rests on the ground, and when the wheels are extended the barrier section is fully supported on the wheels. The barrier sections are pivotally-connected and can be moved from one construction site to another as needs change, for example by being pulled by a tow tractor or other vehicle. Each axle and the wheels can be turned to a position other than perpendicular to the longitudinal extent of the barrier section so that some of the barrier sections can be moved transversely to place them in other than a straight line position.

U.S. Pat. No. 4,666,332, issued May 19, 1987, discloses a traffic barrier carrier or mover enabling the traffic barrier sections to be repositioned according to changing needs. The carrier includes a supporting frame having two opposite end plates upon which the adjacent ends of two generally aligned barrier sections are supported. The frame carries a hydraulic cylinder which raises and lowers supporting wheels mounted on an axle under the frame. The wheels are moved between an upper position located above the lower extremities of the supporting frame with the barrier sections being supported on a surface, and a lower position with the barrier sections being raised above the surface. In the latter position of the wheels, the barrier sections can be towed from one position to another. Steering mechanism can be employed with the wheels of each carrier to steer the barrier sections by means of connecting linkages connected to a piston rod of a hydraulic ram mounted on a towing vehicle support extending upwardly from a tow bar. It is also suggested that steering arms of the steering mechanism can be individually manipulated, as by means of individual hydraulic cylinders or by rack and pinions to provide the desired direction for the barrier sections during towing.

U.S. Pat. No. 6,485,224, issued Nov. 26, 2002, discloses a traffic barrier with a gate between spaced ends of adjacent barrier modules. Cover side plates are removable to expose a pivot pin linkage interconnecting the gate to an adjacent barrier module.

One of the problems encountered in prior art approaches is maintaining proper control of the towed interconnected modules or sections during the towing operation. The prior art techniques exemplified by the U.S. Pat. Nos. 4,666,332 and 5,007,763 cause the sections of the towed traffic barrier to "wander" during towing. Furthermore, prior art elongated traffic barriers incorporating a plurality of segments or modules connected together by pivot linkage are subject to bending or displacement upon impact, for example by a vehicle striking the elongated traffic barrier from the rear or from the side.

DISCLOSURE OF INVENTION

The present invention relates to a towable, articulated, elongated traffic barrier incorporating structural features which improve control and minimize "wandering" of the barrier modules thereof during towing and which strengthen and stabilize the elongated traffic barrier not only during towing, but after the elongated traffic barrier has been repositioned.

The elongated traffic barrier of the present invention includes a plurality of rigid, elongated, double-ended traffic barrier modules.

A connector is located between adjacent traffic barrier modules providing an articulating interconnection therebetween.

Restrictor structure is disposed between adjacent traffic barrier modules and is cooperable with the connector and the adjacent traffic barrier modules to restrict articulation therebetween and resist substantial bending of at least a portion of the elongated traffic barrier.

Each traffic barrier module includes two wheel assemblies spaced from one another and positioned inwardly of the traffic barrier module ends. Each wheel assembly includes a wheel support and a plurality of wheels supported by the wheel support.

Other features, advantages and objects of the present invention will become apparent with reference to the following description and accompanying drawings.

MODES FOR CARRYING OUT THE INVENTION

Co-pending U.S. patent application Ser. No. 11/655,302, filed Jan. 19, 2007, discloses a system for repositioning an elongated traffic barrier in which a tow vehicle is connected to the traffic barrier at or closely adjacent to a first end thereof. The tow vehicle is operable to exert a pulling force on the elongated traffic barrier to pull the elongated traffic barrier while the traffic barrier is in engagement with a support surface to reposition the elongated traffic barrier on the support surface.

In the system a drag is connected to the elongated traffic barrier at or closely adjacent to the other end of the elongated traffic barrier. The drag is operable to exert a drag force on the elongated traffic barrier opposed to the pulling force exerted on the elongated traffic barrier by the tow vehicle to resist "wandering" and bending of the elongated traffic barrier during repositioning.

FIGS. 1-6B hereof show an elongated traffic barrier 10 being pulled or towed from the front end thereof by a tow vehicle 12. A drag vehicle 14 is disposed at the trailing end of elongated traffic barrier 10, the tow vehicle 12 and drag vehicle 14 exerting opposed forces on the elongated traffic barrier 10 as indicated by the arrows. Of course, the force exerted by the tow vehicle is greater than that exerted by the drag vehicle so that the elongated traffic barrier 10 is towed to the left as viewed in FIG. 1.

Figures 1, 2, 3:
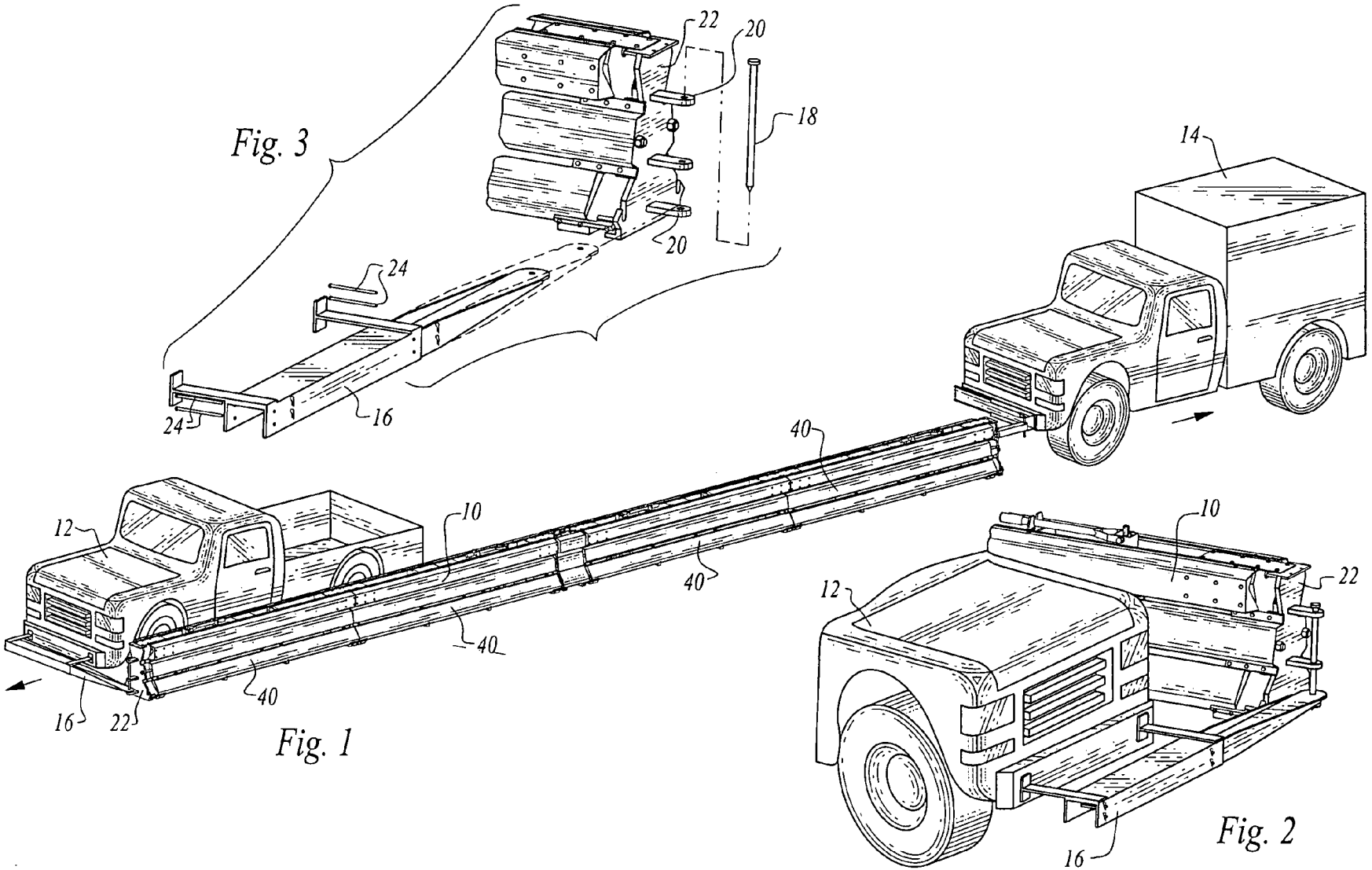
FIG. 1 is a perspective view of an elongated traffic barrier constructed in accordance with the teachings of the present invention being repositioned by a tow vehicle at one end thereof and connected to a drag vehicle at the other end thereof.
FIG. 2 is a perspective view illustrating portions of the tow vehicle and the traffic barrier module to which it is connected during towing.
FIG. 3 is an exploded, perspective view illustrating a tow bar prior to connection thereof by a pivot pin to the front end of the associated traffic barrier module.
Figures 4, 5, 6A, 6B:
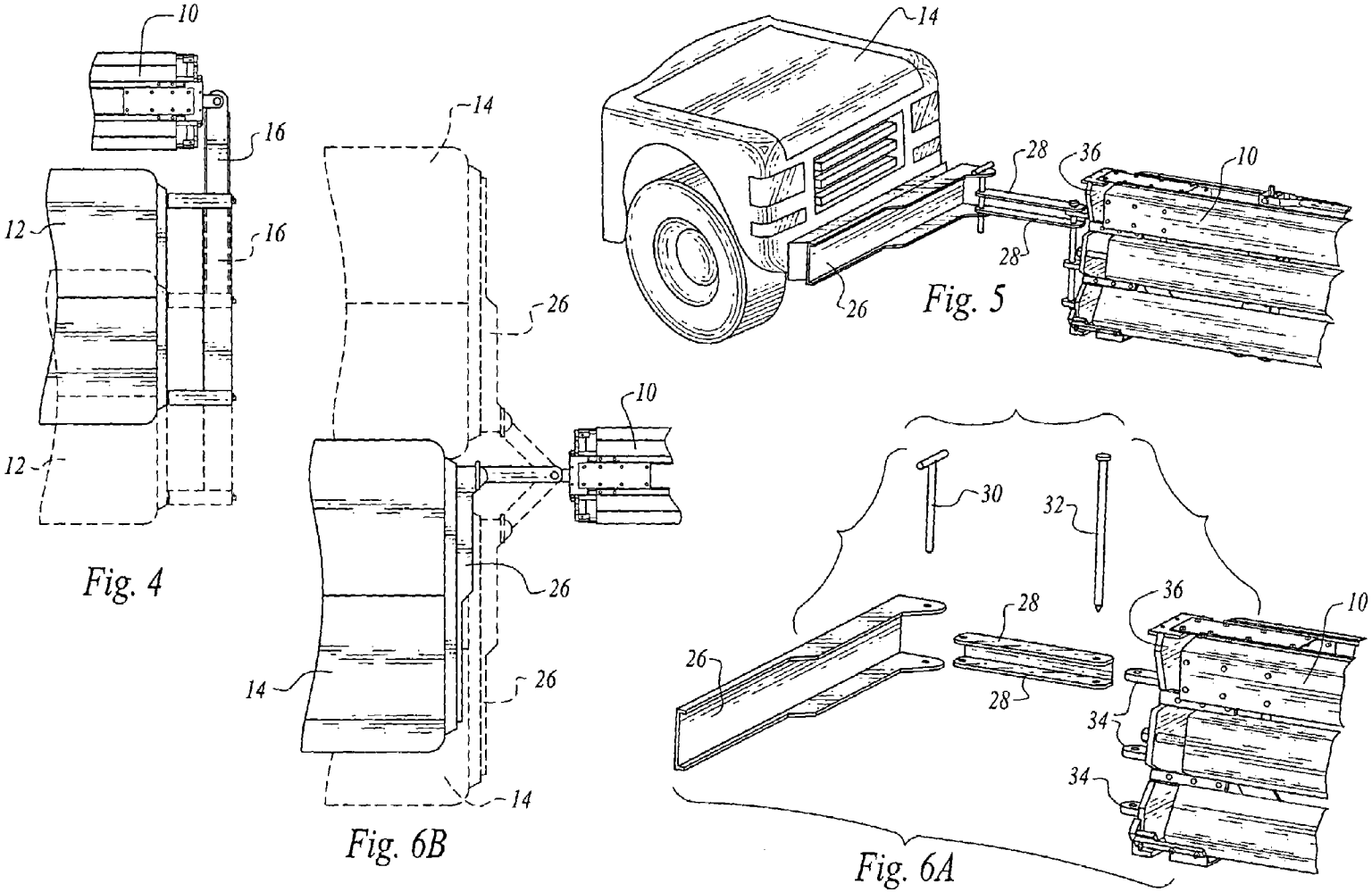
FIG. 4 is a top, plan view showing the tow bar extending between and connected to the tow vehicle and front traffic barrier module.
FIG. 5 is a perspective view of portions of the rear traffic barrier module and drag vehicle connected thereto by linkage.
FIG. 6A is an exploded, perspective view illustrating portions of the rearmost traffic barrier module and a drag bracket, along with connector structure employed to provide an interconnection therebetween.
FIG. 6B is a top, plan view illustrating alternative positions assumable by the front portion of the drag vehicle while interconnected with the rearmost traffic barrier module during towing.

A tow bar 16 is attached to the drag vehicle and projects laterally therefrom, the tow vehicle 12 being disposed alongside the elongated traffic barrier. The distal end of tow bar 16 is connected to the front end of the elongated traffic barrier by a pivot pin 18 which passes through aligned openings in brackets 20 projecting from a front end plate 22 and in the distal end of tow bar 16. Tow bar 16 is of telescopic construction so that the length thereof may be varied as shown in FIG. 3, lock pins 24 being utilized to secure the tow bar in a desired length.

A drag bracket 26 (see FIGS. 5-6B) is attached to the drag vehicle 14. Connector bars 28 of a channel member are secured at one end thereof to the drag bracket by a connector pin 30. A pivot pin 32 passes through openings at the other end of connector bars 28 aligned with openings in rear brackets 34 projecting outwardly from a rear end plate 36 of the elongated traffic barrier.

Elongated traffic barrier 10 includes a plurality of rigid, elongated, double-ended traffic barrier modules 40 which in the illustrated embodiment are of identical construction. FIG. 1, in the interest of simplicity, shows only two such traffic barrier modules, however it is to be understood that more than two traffic barrier modules may be incorporated in the elongated traffic barrier.

Each traffic barrier module 40 includes an inner framework 42, suitably of steel, to which are rigidly secured a plurality of elongated channels 40, also preferably, but not necessarily, made of steel, connected to the framework and extending between the front plate 22 and rear end plate 36 of each module. The end plates are also suitably, but not necessarily, formed of steel.

Figures 7, 8:
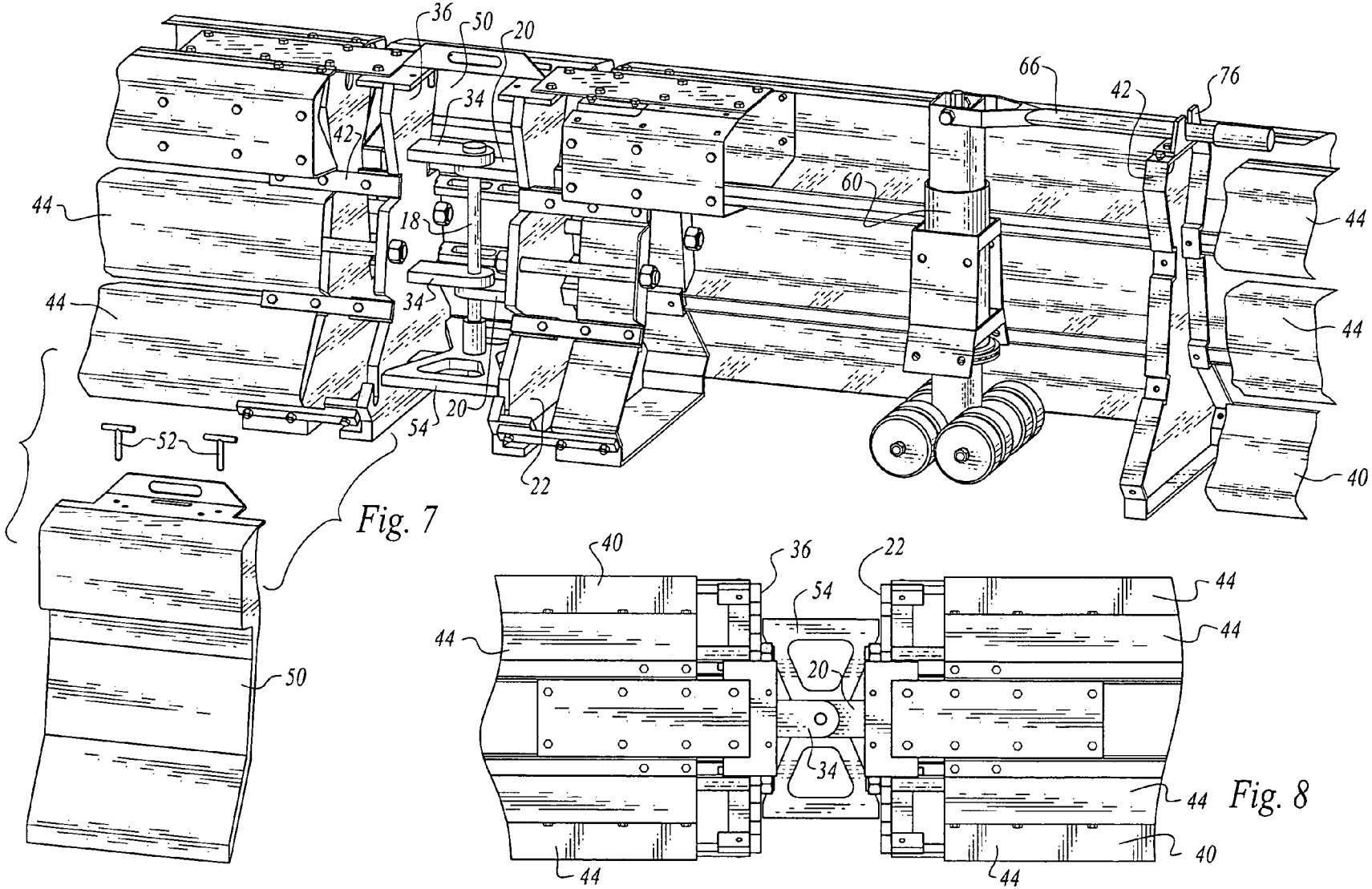
FIG. 7 is an exploded, perspective view illustrating opposed ends of two adjacent traffic barrier modules, with portions of one module broken away and a pivot cover removed to illustrate interior structural details of the elongated traffic barrier.
FIG. 8 is a top, plan view illustrating opposed ends of two adjacent traffic barrier modules with cover plate structure removed to show a pivot restrictor element releasably connected to the pivot connector between the ends of the traffic barrier

An articulated interconnection exists between adjacent traffic barrier modules in the disclosed embodiment due to a pivotal connection therebetween. The adjacent traffic barrier modules are positioned with the front and rear end plates in opposition and defining a space therebetween. The openings in overlapping brackets 20, 34 are aligned. A pivot pin 18 passing through the aligned openings, as shown for example in FIG. 7, provides a pivotal interconnection between the adjacent traffic barrier modules. Once this pivot interconnection has been completed, covers 50 are preferably employed to cover and protect the pivotal connector structure. Pins 52 may be employed for this purpose.

Restrictor structure is disposed in the space between the adjacent traffic barrier modules and is cooperable with the pivot connector structure and the adjacent traffic barrier modules to limit articulative movement between the adjacent traffic barrier modules and resist substantial bending of the portion of the elongated traffic barrier comprising the pivotally connected adjacent traffic barrier modules.

More particularly, the restrictor structure is in the form of a double-ended pivot restrictor element 54 which is of integral construction. The pivot restrictor element 54 includes a stabilizer sleeve 56 defining along with the rest of the pivot restrictor element a throughbore 58. The pivot restrictor element 54 may readily be removed or installed. Installation merely entails positioning the pivot restrictor element on a pair of overlapping brackets so that throughbore 58 aligns with the openings in those brackets as well as with the openings of the other brackets projecting from end plates 22, 36. The pivot pin 18 is then slid through all of the openings and throughbore 58.

Figures 9, 10, 11:
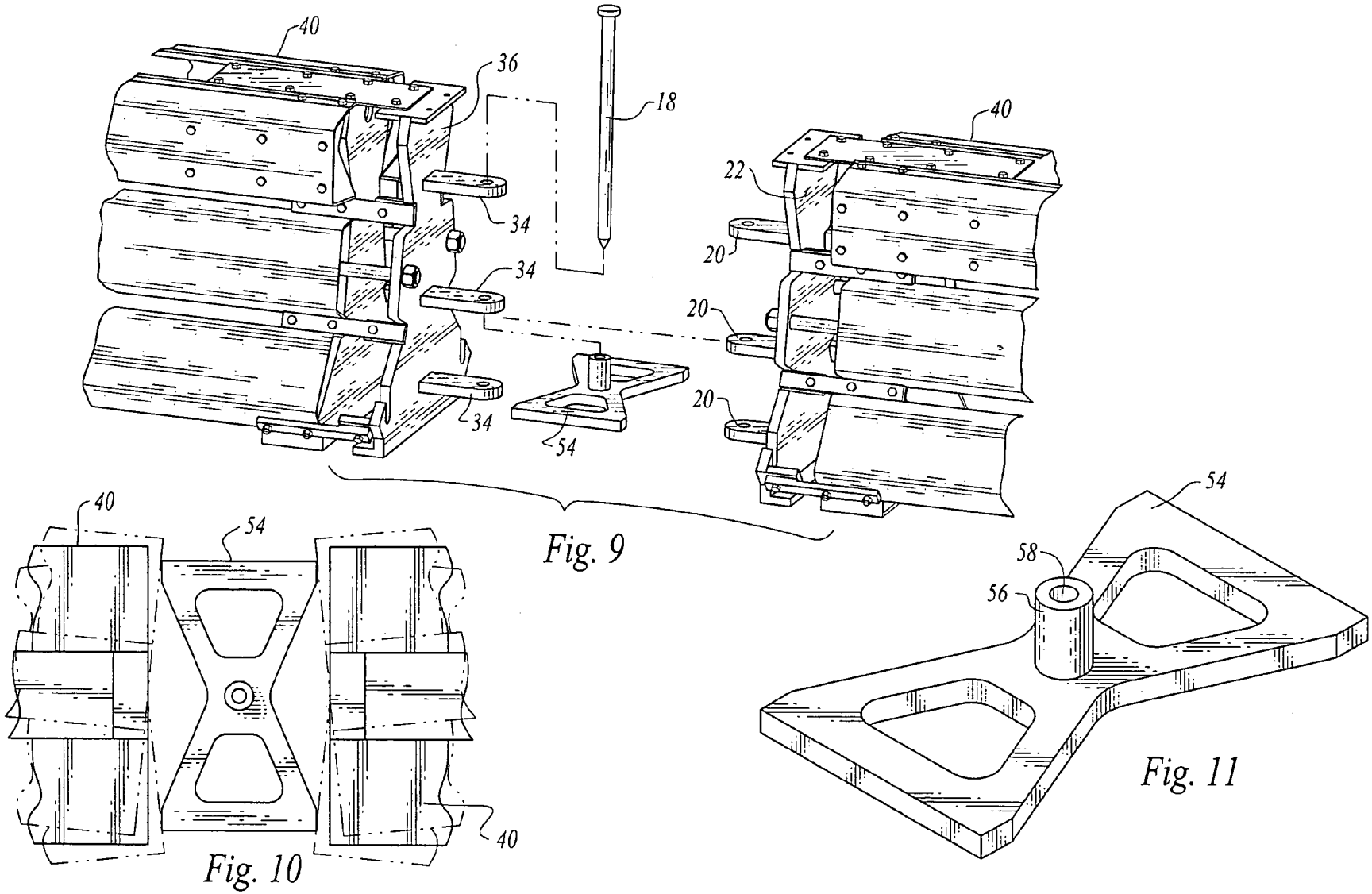
FIG. 9 is an exploded view of the two adjacent traffic modules prior to connection thereof by a pivot pin and prior to installation of the pivot restrictor element.
FIG. 10 is a top, plan view illustrating the pivot restrictor element engageable with the ends of the adjacent traffic barrier modules to limit pivoting therebetween, the modules being shown in alternative positions.
FIG. 11 is an enlarged, perspective view of the pivot restrictor element.
Figure 14:
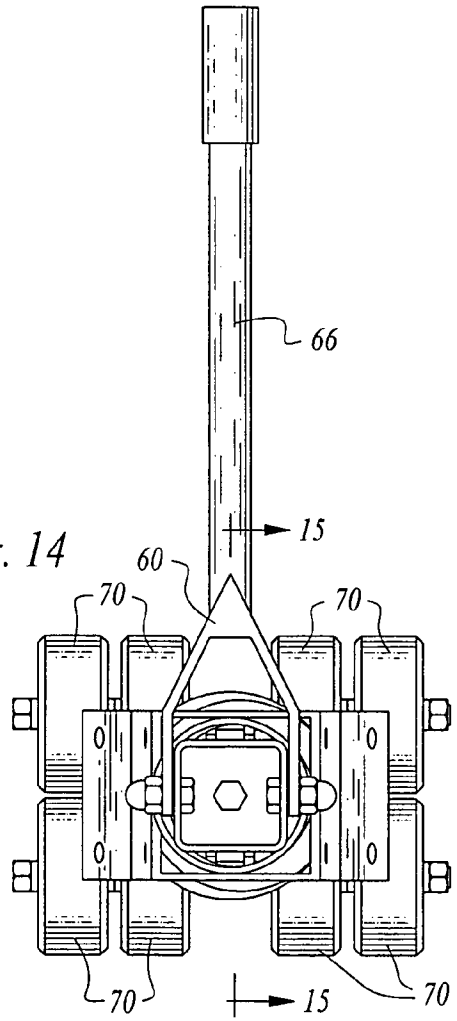
FIG. 14 is a top, plan view of the wheel assembly and associated tiller in the orientation of FIG. 12.
Figure 13:
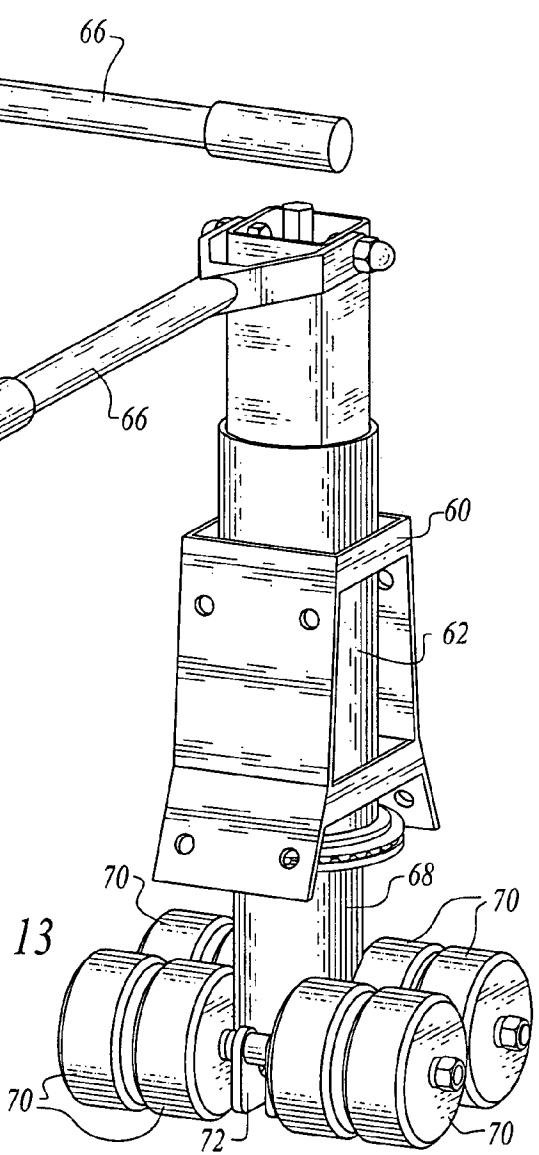
FIGS. 12 and 13 are perspective views of a wheel assembly employed in the elongated traffic barrier, the wheels oriented ninety degrees with respect to one another in these figures.
Figure 12:
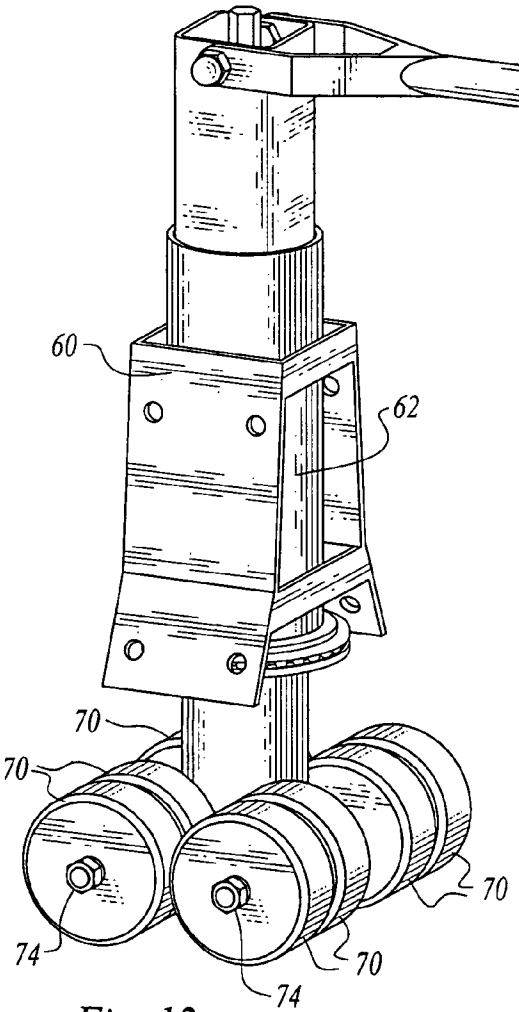

The pivot restrictor element 54 projects outwardly from the pivot pin in opposed directions alongside and between the spaced end plates 22, 36 of the adjacent barrier modules. As illustrated in FIG. 10, the pivot restrictor element is engaged with the opposed end plates of the adjacent traffic barrier modules when the modules are pivoted about the pivot pin. This represents a convenient and efficient approach for stiffening the elongated traffic barrier to provide the advantages set forth above, including complete or substantial elimination of wandering during towing. A pivot restrictor element may be positioned between all of the adjacent traffic barrier modules of an elongated traffic barrier.

Each traffic barrier module 40 includes two wheel assemblies 60, details of which are shown in FIGS. 12-17. The two wheel assemblies of each traffic barrier module 40 are spaced from one another and spaced inwardly of the ends thereof. The wheel assemblies are secured to the inner framework of the traffic barrier module by mechanical fasteners of any suitable type. Each wheel assembly 60 includes an outer housing 62 and an inner housing 64 rotatable relative to the outer housing by a tiller 66. The inner housing 64 includes a lower telescoping member 68 which may be raised or lowered by a jack screw 70 (see FIGS. 15, 16). The telescoping member 68 rotates with the rest of inner housing 64 to change the direction of wheels 70 on a rocker arm wheel support 72 disposed at the lower end of telescoping member 68.

Two parallel axles 74 project from both sides of rocker arm wheel support 72. In the arrangement illustrated, there are front and rear sets of wheels 70, each set of wheels including four wheels, two to a side of the telescoping member 68. Such an arrangement incorporating two wheel assemblies provides for substantial distribution of the module's weight to the ground at each wheel assembly. Furthermore, two wheel assemblies provide better control of module movement. The rocker arm wheel support 72 allows for ready adjustment of the wheels to irregular terrain.

As indicated above, the tiller 66 is employed to steer the wheels 70. One or both of the tillers may be locked in position so that the wheels associated therewith are oriented in the direction of the longitudinal axis of the associated traffic barrier module. FIG. 7 shows a tiller captured in a notch in a projection 76 to lock it against sideways movement.

Figure 18:
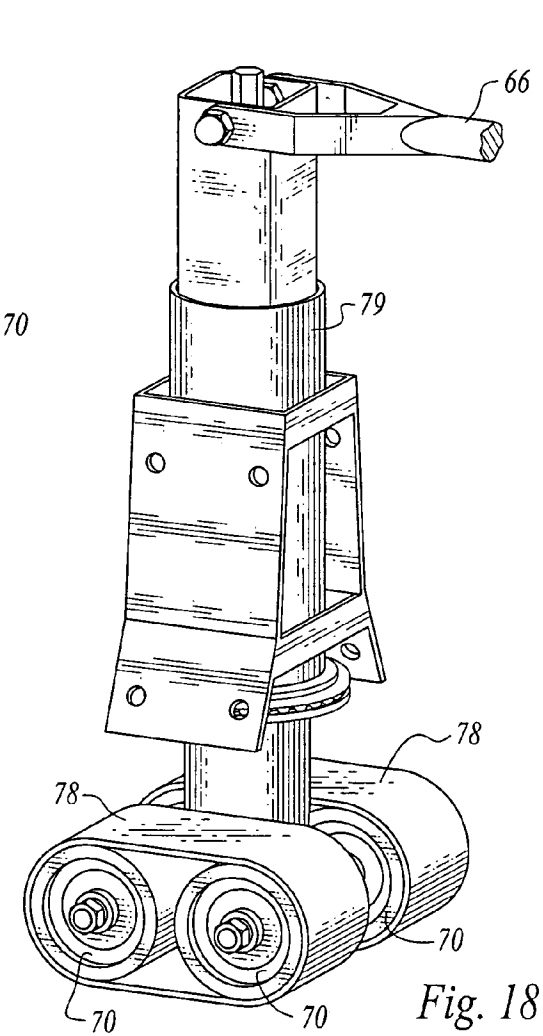
FIG. 18 is a perspective view of an alternative embodiment of wheel support.
Figure 17:
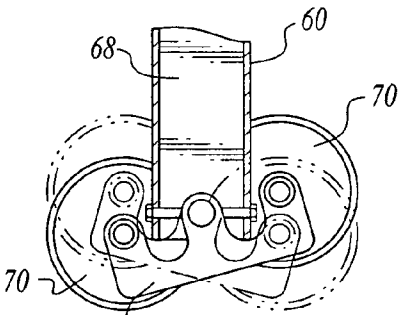
FIG. 17 is a cross-sectional view illustrating pivoting action of a rocker arm supporting the wheels.
Figure 16:
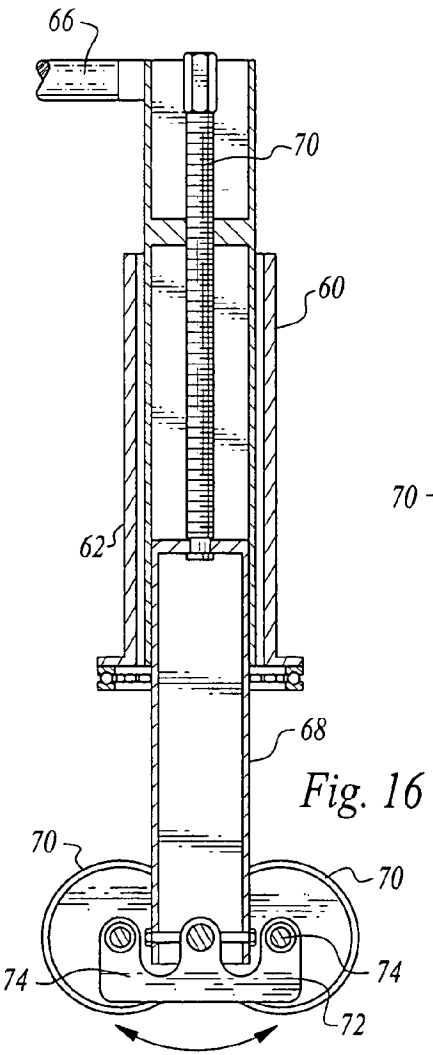
FIG. 16 is a view similar to FIG. 17, but illustrating the wheels in lowered condition.
Figure 15:
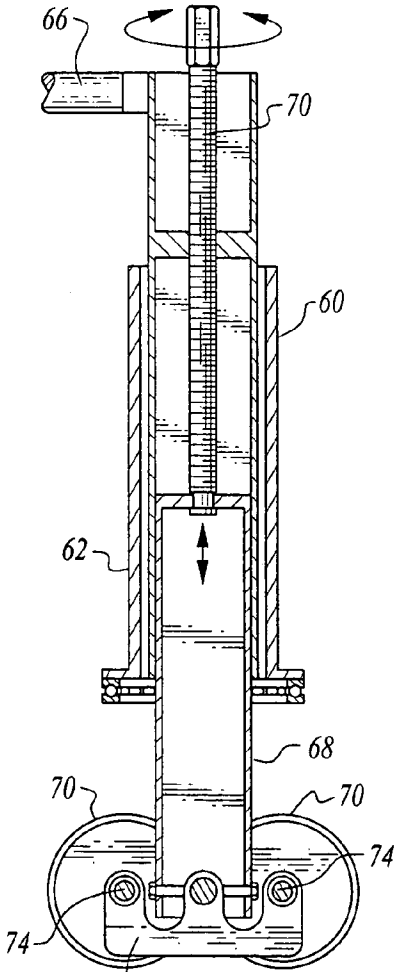
FIG. 15 is a cross-sectional view taken along the line 15-15 of FIG. 14 with the wheels of the assembly in raised condition and illustrating operation of a jack incorporated in the wheel assembly.
Figure 21:
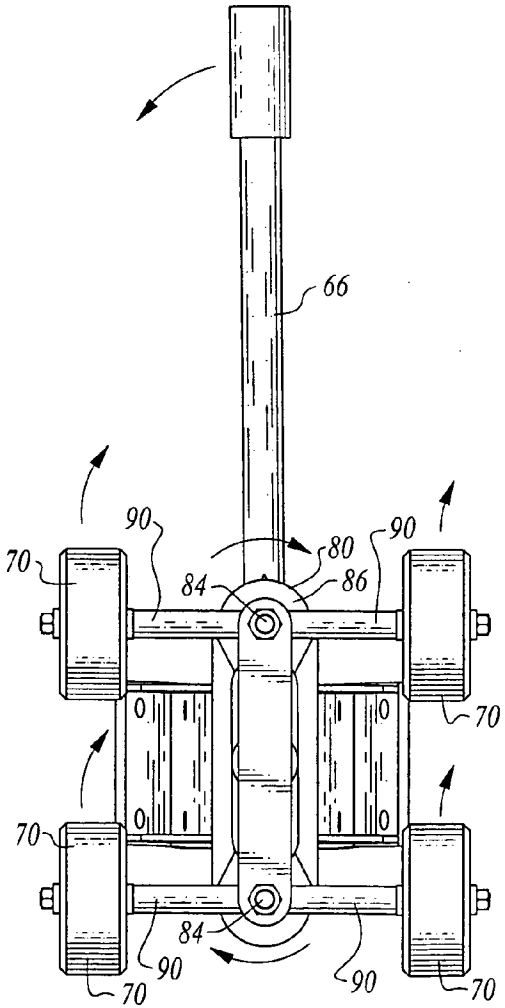
FIG. 21 is a top, plan view of the third embodiment.
Figure 20:
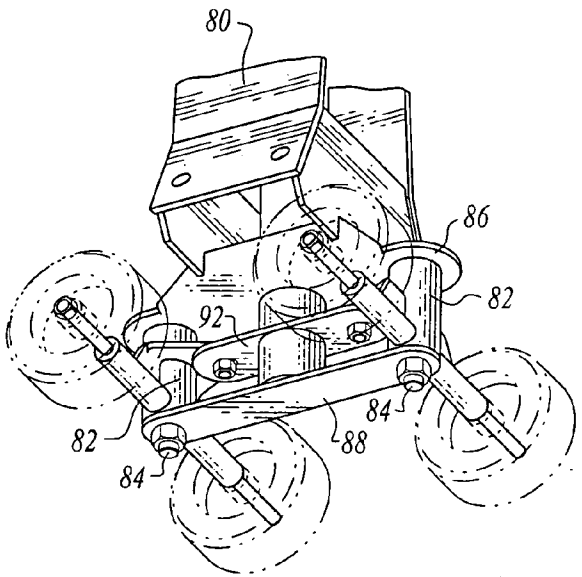
FIG. 20 is a bottom perspective view illustrating details of the wheel support structure of the embodiment of FIG. 19.
Figure 19:
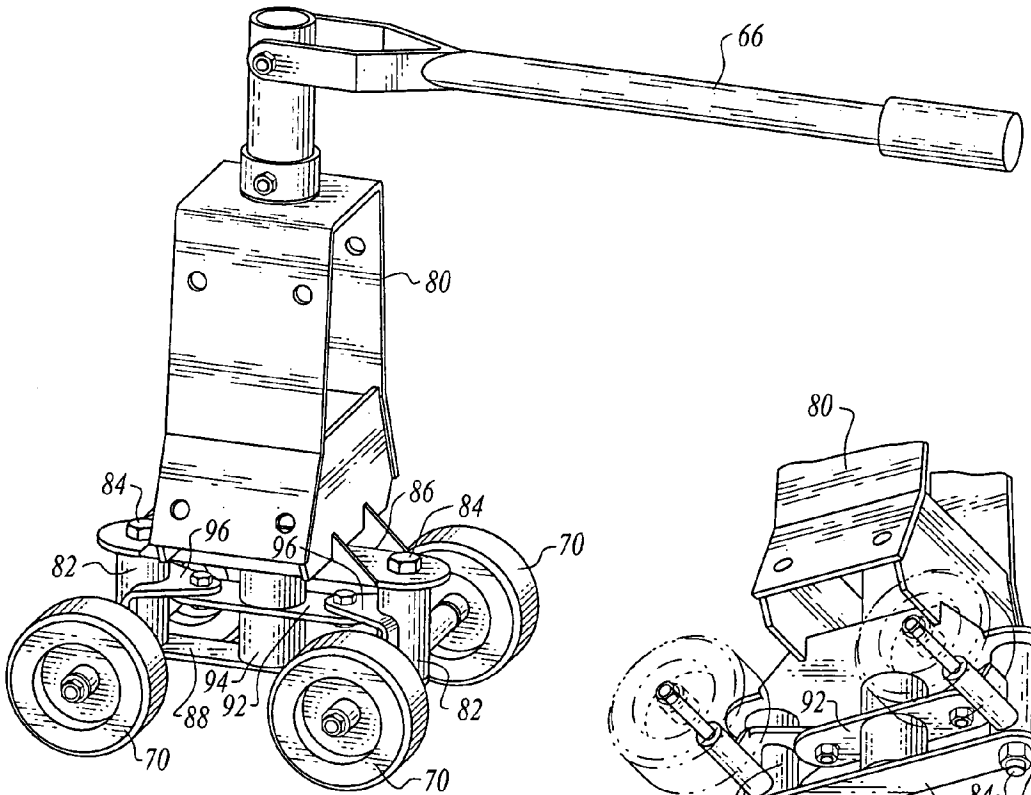
FIG. 19 is a perspective view of a third embodiment of wheel assembly.
Figure 24:
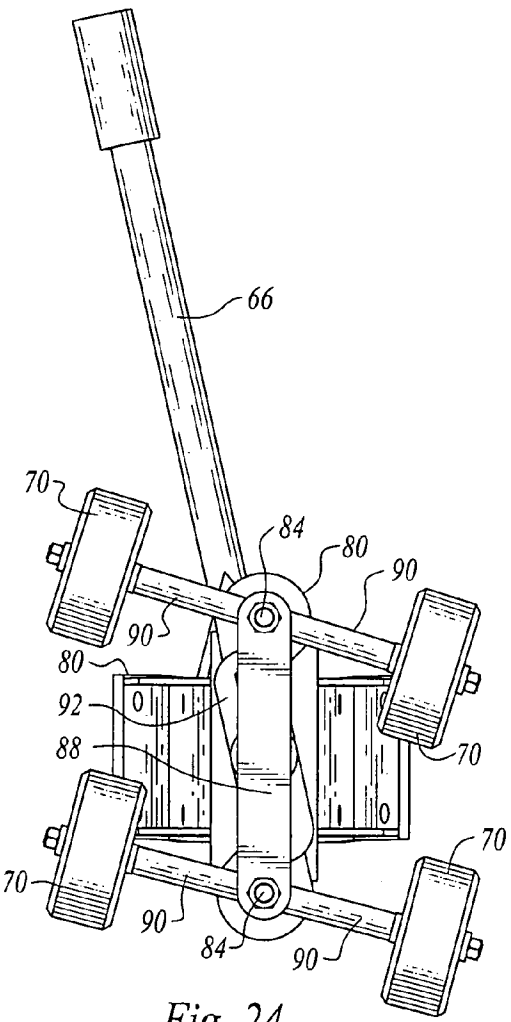
FIG. 24 is a view similar to that of FIG. 21, but showing the wheels turned in a different direction.
Figure 23:
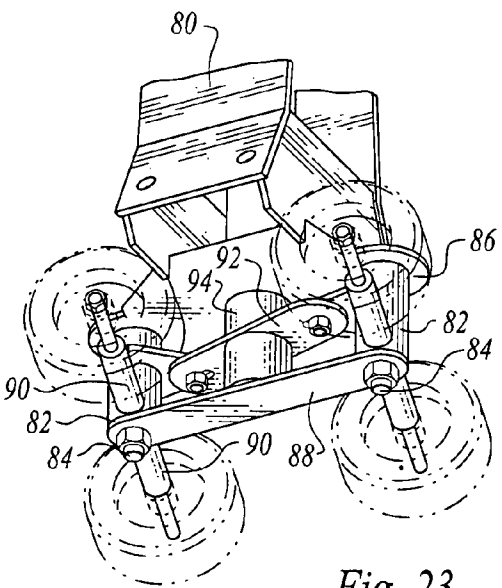
FIG. 23 is a view similar to that of FIG. 20, but showing the wheels turned in a different direction.
Figure 22:
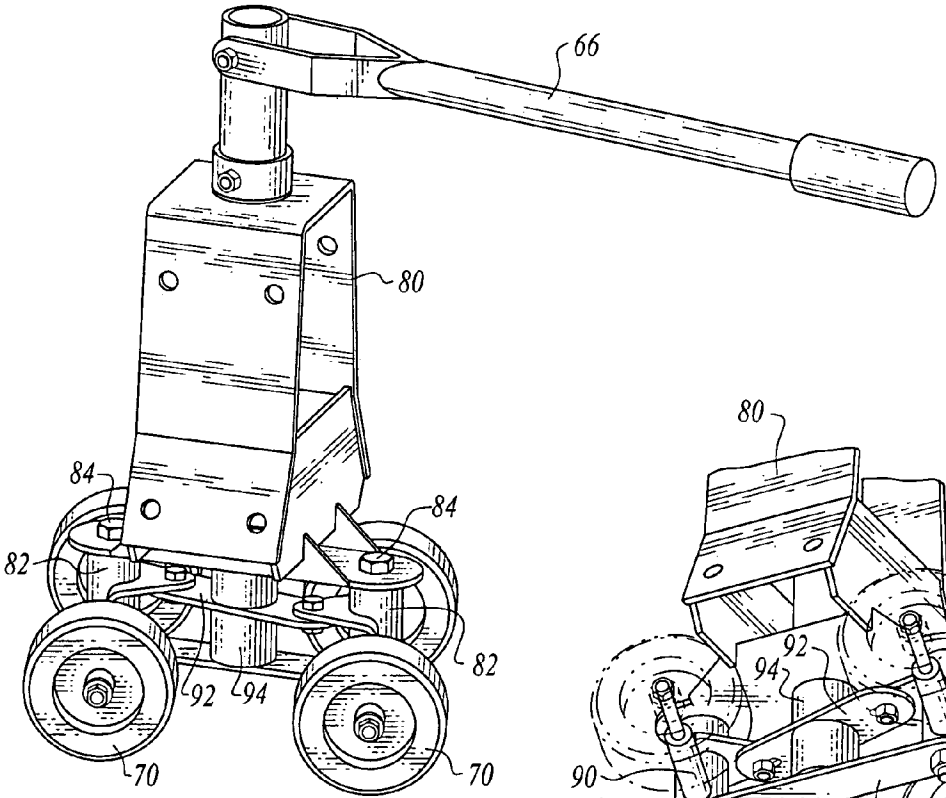
FIG. 22 is a view similar to that of FIG. 19, but showing the wheels turned in a different direction.

FIG. 18 illustrates an alternative wheel assembly 79 which differs from wheel assembly 60 only in that it includes a pair of endless ground engaging belts 78 extending around and between the front and rear sets of wheels.

Referring now to FIGS. 19-24, another wheel assembly embodiment, wheel assembly 80, is illustrated. Wheel assembly 80 discloses a wheel support including two sleeves 82 rotatably mounted on pivot bolts 84 extending between a support plate 86 and a bottom plate 88.

Axles 90 project from opposed sides of each sleeve 82, a wheel 70 located at the end of each axle. A double-ended drive plate 92 is located above bottom plate 88, the drive plate being affixed to a rotatable drive shaft 94 rotatable by a tiller 66. The distal ends of the drive plate 92 are pivotally connected by mechanical fasteners to a projection 96 affixed to each of the sleeves 82.

Rotation of drive shaft 94 and drive plate 92 by tiller 66 will result in repositioning of the wheels 70 to steer the wheel assembly and the traffic barrier module with which it is associated. In this embodiment, there is no jack and the wheels remain in ground engaging position.

The invention claimed is:

1. A towable elongated traffic barrier comprising, in combination:

a plurality of substantially rigid, elongated, double-ended traffic barrier modules;

a connector located between adjacent traffic barrier modules of said plurality of traffic barrier modules providing a pivotal interconnection between said adjacent traffic barrier modules, said adjacent traffic barrier modules having opposed traffic barrier ends defining a space therebetween and said connector allowing relative movement between said opposed traffic barrier ends, at least one of said traffic barrier modules including two wheel assemblies spaced from one another and positioned inwardly of the ends thereof, each wheel assembly including a wheel support and a plurality of wheels supported by said wheel support and restrictor structure disposed in said space between said opposed traffic barrier module ends at said connector and cooperable with said connector and said adjacent traffic barrier modules to restrict relative pivotal movement between said adjacent traffic barrier modules at said connector by simultaneously engaging the opposed traffic barrier ends at locations spaced from said connector and resist substantial bending of at least a portion of said elongated traffic barrier.

2. The elongated traffic barrier according to claim 1 wherein at least one of said two wheel assemblies includes a tiller for changing wheel direction.

3. The elongated traffic barrier according to claim 2 additionally comprising lock structure for selectively locking the tiller against movement.

4. The elongated traffic barrier according to claim 3 wherein said wheels comprise spaced front and rear sets of wheels, each set of wheels including at least two wheels supported by said wheel support.

5. The elongated traffic barrier according to claim 4 wherein endless ground engaging belts extend around and between the wheels of said front and rear sets of wheels.

6. The elongated traffic barrier according to claim 4 wherein each set of wheels includes at least four wheels.

7. The elongated barrier according to claim 6 wherein said wheel support includes at least one rocker arm, said sets of wheels being rotatably mounted on said at least one rocker arm.

* * * * *